US007723002B2

(12) United States Patent
Shimokusa et al.

(10) Patent No.: US 7,723,002 B2
(45) Date of Patent: May 25, 2010

(54) TONER FOR ELECTROSTATIC IMAGE DEVELOPMENT

(75) Inventors: Koji Shimokusa, Wakayama (JP); Shinichi Sata, Wakayama (JP); Yasuhiro Hidaka, Wakayama (JP)

(73) Assignee: Kao Corporation, Tokyo (JP)

( * ) Notice: Subject to any disclaimer, the term of this patent is extended or adjusted under 35 U.S.C. 154(b) by 517 days.

(21) Appl. No.: 10/947,387

(22) Filed: Sep. 23, 2004

(65) Prior Publication Data

US 2005/0095523 A1 May 5, 2005

(30) Foreign Application Priority Data

Sep. 26, 2003 (JP) ..... 2003-336290
Feb. 17, 2004 (JP) ..... 2004-040129

(51) Int. Cl.
*G03G 9/087* (2006.01)

(52) U.S. Cl. ..... 430/108.8; 430/109.4; 430/108.1

(58) Field of Classification Search ..... 430/108.4, 430/108.1, 109.4, 108.8
See application file for complete search history.

(56) References Cited

U.S. PATENT DOCUMENTS 6,383,705 B2 5/2002 Aoki et al.
2001/0018157 A1* 8/2001 Aoki et al. ..... 430/109.4
2003/0108808 A1* 6/2003 Inoue et al. ..... 430/109.4
2003/0203301 A1* 10/2003 Iga ..... 430/108.1
2003/0224278 A1* 12/2003 Shirai et al. ..... 430/109.4
2004/0152813 A1* 8/2004 Shirai ..... 524/275
2004/0197691 A1* 10/2004 Moriyama et al. ..... 430/108.4

FOREIGN PATENT DOCUMENTS

JP 11327193 A * 11/1999
JP 2001-51445 2/2001
JP 2001-222138 8/2001
JP 2002-40705 2/2002
JP 2002-328490 11/2002
JP 2003-186244 7/2003

OTHER PUBLICATIONS

Aoki, Takayoshi. "Chemical Toner Technology and The Future". IS&T's NIP 19: 2003 International Conference on Digital Printing Technologies. pp. 2-4 (Oct. 2003).*
Eiji Shirai et al. "The toner for low energy fusing by using crystalline polyester" IS&T's NIP 18: International Conference on Digital Printing Technologies, (2002) pp. 258-261.*
English language translation of JP 11-327193 (Nov. 1999)/.*
U.S. Appl. No. 11/423,792, filed Jun. 13, 2006, Eida, et al.
U.S. Appl. No. 11/199,250, filed Aug. 9, 2005, Hidaka.
Patent Abstracts of Japan, JP 2000-131889, May 12, 2000.
Patent Abstracts of Japan, JP 1-161259, Jun. 23, 1989.

* cited by examiner

*Primary Examiner*—Christopher RoDee
(74) *Attorney, Agent, or Firm*—Oblon, Spivak, McClelland, Maier & Neustadt, L.L.P.

(57) ABSTRACT

A toner for electrostatic image development, comprising a resin binder comprising a crystalline polyester; a releasing agent comprising a wax having a melting point of from 60 to 85° C. and a penetration at 25° C. of from 4 to 10; and a colorant. The toner for electrostatic image development can be used, for instance, for the development of a latent image formed in electrophotography, electrostatic recording method, electrostatic printing method or the like.

15 Claims, No Drawings

TONER FOR ELECTROSTATIC IMAGE DEVELOPMENT

FIELD OF THE INVENTION

The present invention relates to a toner for electrostatic image development used, for instance, for the development of a latent image formed in electrophotography, electrostatic recording method, electrostatic printing method or the like, and a process for preparing the same.

BACKGROUND OF THE INVENTION

Japanese Patent Publication No. JP-A-2001-222138 discloses a toner for electrophotography containing a resin binder containing a crystalline polyester, and a wax having a melting point lower than a softening point of the crystalline polyester by 10° C. or more, whereby improving low-temperature fixing ability, offset resistance, blocking resistance and durability of the toner.

Japanese Patent Publication No. JP-A-2000-131889 discloses a pulverized toner containing a mixture of a styrenic resin having a carboxyl group as a functional group, a paraffin wax having a melting point of 75° C., and a Fischer-Tropsch wax having a melting point of 105° C., whereby improving the plasticizing action and releasing action concurrently.

Japanese Patent Publication No. JP-A-Hei 1-161259 discloses a toner for electrostatic image development, containing a resin for a toner containing a specified binding substance of a crystalline polyester and a specified amorphous vinyl polymer, and a paraffin wax, whereby improving low-temperature fixing ability, hot-offset resistance, under-offset resistance, toner storage property, and toner fluidity in a two-component development method.

SUMMARY OF THE INVENTION

The present invention relates to:

(1) a toner for electrostatic image development, comprising:
  a resin binder comprising a crystalline polyester;
  a releasing agent comprising a wax having a melting point of from 60 to 85° C. and a penetration at 25° C. of from 4 to 10; and
  a colorant; and (2) a process for preparing a toner for electrostatic image development, comprising the step of melt-kneading raw materials of the above toner, wherein the melt-kneading step is carried out with an open roller-type kneader.

DETAILED DESCRIPTION OF THE INVENTION

The present invention relates to a toner for electrostatic image development which is excellent in both low-temperature fixing ability and durability even when used, for instance, in an oil-less fusing type apparatus for forming fixed images, and a process for preparing the same.

The toner for electrostatic image development of the present invention exhibits an excellent effect that both low-temperature fixing ability and durability of the toner are satisfied even when used, for instance, in an oil-less fusing type apparatus for forming fixed images.

These and other advantages of the present invention will be apparent from the following description.

In order to achieve cost reduction and miniaturization of the recent apparatus for forming fixed images such as copy machines and printers, there is a remarkable widespread of oil-less fusing type apparatuses, and the demands for higher speeds have been increasing. In order to satisfy miniaturization and speed-up of the oil-less fusing type apparatus for forming fixed images, one of the important functions required in a toner for electrostatic image development is low-temperature fixing ability.

The present inventors have tried to improve low-temperature fixing ability of a toner for electrostatic image development (hereinafter which may also be simply referred to as "toner") from the viewpoint of effectively using a wax having a low melting point, especially a low-melting point wax having a melting point of 85° C. or less which has not been conventionally sufficiently studied.

As a result, there is a serious problem which is a set back upon the use of a low-melting point wax. In the preparation of a toner, especially in a case where a toner is prepared through a step of melt-kneading raw materials such as a resin binder, a colorant and a releasing agent, the low-melting point wax is not sufficiently dispersed in conventionally widely used amorphous resins.

The reason therefor is that the softening point of the amorphous resin is high and the viscosity during melt-kneading is high, so that the dispersion of a low-melting point wax having a low viscosity is inhibited.

Here, if the softening point of the amorphous resin is lowered, the glass transition temperature of the amorphous resin is also lowered even though the dispersibility of the low-melting point wax during the melt-kneading is improved. Therefore, the prepared toner is a serious problem for practical purposes that the toner has a lower durability when used in an apparatus for forming fixed images.

On the other hand, in order to improve the disadvantage in the amorphous resin, a technique in which the crystalline resin is made to good use, and used together with a wax has been studied (Japanese Patent Publication Nos. JP-A-2001-222138, JP-A-2000-131889, and JP-A-Hei 1-161259). However, these publications do not specifically disclose a combined use with a low-melting point wax having a melting point of 85° C. or less.

Therefore, the present inventors have reviewed the resin binder and the wax from the viewpoint of dispersibility of the low-melting point wax during the melt-kneading and durability upon the use of a toner. As a result, they have found that the combination of the crystalline polyester and the low-melting point wax having specified properties is an excellent means to solve the above-mentioned problems.

The resin binder in the present invention contains a crystalline polyester. Here, in the present invention, the term "crystalline" means that a ratio of the softening point to the maximum peak temperature of heat of fusion (softening point/peak temperature) is from 0.6 to 1.3, preferably from 0.9 to 1.2, more preferably from 0.95 to 1.1. Also, the term "amorphous" means that a ratio of the softening point to the maximum peak temperature of heat of fusion (softening point/peak temperature) is exceeding 1.3 and 4 or less, preferably from 1.5 to 3. Here, the maximum peak refers to a peak of which height becomes the maximum.

In the present invention, it is preferable that the crystalline polyester is a resin prepared by polycondensing an alcohol component containing 80% by mol or more of an aliphatic diol having 2 to 6 carbon atoms, preferably 4 to 6 carbon atoms, and a carboxylic acid component containing 80% by mol or more of an aliphatic dicarboxylic compound having 2 to 8 carbon atoms, preferably 4 to 6 carbon atoms, more preferably 4 carbon atoms.

The aliphatic diol having 2 to 6 carbon atoms includes ethylene glycol, 1,2-propylene glycol, 1,3-propylene glycol, 1,4-butanediol, 1,5-pentanediol, 1,6-hexanediol, neopentyl glycol, 1,4-butanediol, and the like, even more preferably an α, ω-linear alkanediol.

It is desired that the aliphatic diol having 2 to 6 carbon atoms is contained in the alcohol component in an amount of 80% by mol or more, preferably from 80 to 100% by mol, and more preferably from 90 to 100% by mol. Even more preferably, it is desired that one aliphatic diol constitutes 70% by mol or more, preferably 80 to 95% by mol, of the alcohol component. Above all, it is desired that 1,4-butanediol is contained in the alcohol component in an amount of preferably 60% by mol or more, more preferably from 70 to 100% by mol, even more preferably from 80 to 100% by mol.

The alcohol component may contain a polyhydric alcohol component other than the aliphatic diol having 2 to 6 carbon atoms. The polyhydric alcohol component includes a divalent aromatic alcohol such as an alkylene(2 to 3 carbon atoms) oxide adduct (average number of moles added being 1 to 10) of bisphenol A, such as polyoxypropylene(2.2)-2,2-bis(4-hydroxyphenyl)propane and polyoxyethylene(2.2)-2,2-bis(4-hydroxyphenyl)propane; a trihydric or higher polyhydric alcohol such as glycerol, pentaerythritol and trimethylolpropane.

The aliphatic dicarboxylic acid compound having 2 to 8 carbon atoms includes oxalic acid, malonic acid, maleic acid, fumaric acid, citraconic acid, itaconic acid, glutaconic acid, succinic acid, adipic acid, anhydrides thereof, alkyl(1 to 3 carbon atoms) esters thereof, and the like, among which fumaric acid and adipic acid are preferable, and fumaric acid is more preferable. Incidentally, as described above, the aliphatic dicarboxylic acid compound refers to an aliphatic dicarboxylic acid, an anhydride thereof and an alkyl(1 to 3 carbon atoms) ester thereof, among which the aliphatic dicarboxylic acid is preferable.

It is desired that the aliphatic dicarboxylic acid compound having 2 to 8 carbon atoms is contained in the carboxylic acid component in an amount of 80% by mol or more, preferably from 80 to 100% by mol, and more preferably from 90 to 100% by mol. Even more preferably, it is desired that one aliphatic dicarboxylic acid compound constitutes 60% by mol or more, preferably 70% by mol or more, more preferably from 80 to 100% by mol, of the carboxylic acid component. Above all, it is desired that fumaric acid is contained in the carboxylic acid component in an amount of preferably 60% by mol or more, more preferably from 60 to 90% by mol, even more preferably from 60 to 80% by mol.

The carboxylic acid component may contain a polycarboxylic acid component other than the aliphatic dicarboxylic acid compound having 2 to 8 carbon atoms. The polycarboxylic acid component includes aromatic dicarboxylic acids such as phthalic acid, isophthalic acid and terephthalic acid; aliphatic dicarboxylic acids such as sebacic acid, azelaic acid, n-dodecylsuccinic acid and n-dodecenylsuccinic acid; alicyclic dicarboxylic acids such as cyclohexanedicarboxylic acids; tricarboxylic or higher polycarboxylic acids such as trimellitic acid and pyromellitic acid; anhydrides thereof, alkyl(1 to 3 carbon atoms) esters thereof, and the like.

The polycondensation of the alcohol component and the carboxylic acid component can be carried out, for instance, by the reaction at a temperature of from 120° to 230° C. in an inert gas atmosphere, using an esterification catalyst, a polymerization inhibitor or the like as occasion demands. Specifically, in order to enhance the strength of the resin, an entire monomer may be charged at once. Alternatively, in order to reduce the low-molecular weight components, divalent monomers may be firstly reacted, and thereafter trivalent or higher polyvalent monomers are added and reacted.

In addition, the reaction may be accelerated by reducing the pressure of the reaction system in the second half of the polymerization. In the present invention, in order to reduce the influence of the aromatic compound on the properties of the crystalline polyester and obtain desired effects in a small amount, preferable is a process of polycondensing the monomers other than the divalent aromatic compounds at a reactivity of 50% or more, more preferably 80% or more, and even more preferably 90% or more, thereafter adding the divalent aromatic compound to the reaction system, and further polycondensing the monomers. Here, the reactivity is obtained in a ratio (molar ratio) of an amount of water distilled off from the reaction system to a theoretical amount of water dehydration during the polycondensation.

The molecular weight of the crystalline polyester is such that the number-average molecular weight is preferably 2,000 or more, more preferably 3,000 or more, even more preferably 4,000 or more, from the viewpoint of storage property and durability of the toner. In consideration of productivity of the crystalline polyester, however, the number-average molecular weight is preferably 10,000 or less, more preferably 8,000 or less, even more preferably 6,000 or less.

In addition, the weight-average molecular weight is preferably 9,000 or more, more preferably 50,000 or more, even more preferably 100,000 or more, and the weight-average molecular weight is preferably 1,000,000 or less, more preferably 500,000 or less, even more preferably 300,000 or less, from the same viewpoint as the number-average molecular weight.

Here, in the present invention, both of the number-average molecular weight and the weight-average molecular weight of the crystalline polyester are the values obtained by determining chloroform-soluble components.

In order to obtain a high-molecular crystalline polyester, there may be selected reaction conditions such as adjustment of the molar ratio of the carboxylic acid component to the alcohol component, elevation of the reaction temperature, increase in the amount of the catalyst, and performance of a dehydration reaction for a long period of time under reduced pressure. Incidentally, a high-molecular crystalline polyester can be also prepared by using a high-output motor. However, a process of reacting raw material monomers together with non-reactive low-viscosity resin and a solvent is also an effective means when the crystalline polyester is prepared without particularly selecting preparation equipment.

Here, the molar ratio of the carboxylic acid component to the alcohol component, i.e. carboxylic acid component/alcohol component, in the crystalline polyester is such that the greater the alcohol component than the carboxylic acid component the better, from the viewpoint of obtaining an even high-molecular crystalline polyester. Further, the molar ratio is preferably from 0.7 to 1.5, more preferably from 0.9 to 1.1, from the viewpoint of easily adjusting the molecular weight of the polyester by distilling off the alcohol component during vacuum reaction.

The crystalline polyester has a softening point of preferably from 80° to 150° C., more preferably from 85° to 130° C., and a maximum peak temperature of heat of fusion of preferably from 75° to 150° C., more preferably from 85° to 130° C.

The content of the crystalline polyester in the resin binder is preferably from 1 to 50% by weight, more preferably from 5 to 40% by weight, even more preferably from 10 to 30% by weight, from the viewpoint of wider fixable temperature range, and excellent storage property, fixing ability and productivity of the toner.

It is preferable that the toner of the present invention further contains an amorphous resin as the resin binder from the viewpoint of offset resistance and maintenance of melt viscosity during the melt-kneading. The amorphous resin includes amorphous polyesters, amorphous polyester-polyamides, amorphous styrene-acrylic resins, and the like. Among them, the amorphous polyesters are preferable, from the viewpoint of fixing ability and compatibility with the crystalline polyester.

The amorphous polyester can be prepared by polycondensing an alcohol component and a carboxylic acid component in the same manner as in the crystalline polyester. Here, in order to prepare an amorphous polyester, it is preferable that the following requirements are met:

(1) in a case where monomers for accelerating crystallization of a resin, such as an aliphatic diol having 2 to 6 carbon atoms and an aliphatic dicarboxylic compound having 2 to 8 carbon atoms, are used, a resin in which crystallization is suppressed by using two or more of these monomers in combination, in each of the alcohol component and the carboxylic acid component, one of these monomers is used in an amount of from 10 to 70% by mol, preferably 20 to 60% by mol of each component, and these monomers are used in two or more kinds, preferably two to four kinds; or (2) a resin obtained from monomers for accelerating amorphousness of a resin, preferably an alkylene oxide adduct of bisphenol A as an alcohol component, or an aromatic carboxylic acid or a substituted succinic acid of which substituent is an alkyl group or alkenyl group as a carboxylic acid component are used in an amount of from 30 to 100% by mol, preferably from 50 to 100% by mol, of the alcohol component or the carboxylic acid component, preferably of the alcohol component and the carboxylic acid component, respectively.

The amorphous resin has a softening point of preferably from 70° to 180° C., more preferably from 100° to 160° C., and a glass transition temperature of preferably from 45° to 80° C., more preferably from 55° to 75° C. Incidentally, glass transition temperature is a property intrinsically owned by an amorphous resin, and is distinguished from the maximum peak temperature of heat of fusion.

The amorphous polyester has a number-average molecular weight of preferably from 1,000 to 6,000, more preferably from 2,000 to 5,000, and a weight-average molecular weight is preferably 10,000 or more, more preferably 30,000 or more, and preferably 1,000,000 or less.

Incidentally, it is preferable that the amorphous polyester contains two kinds of amorphous polyesters of which softening points are different by 10° C. or more. Even more, it is preferable that a low-softening point polyester having a softening point of 70° C. or more and less than 120° C., and a high-softening point polyester having a softening point of 120° C. or more and 180° C. or less are used together in a weight ratio (low-softening point polyester/high-softening point polyester) of preferably from 20/80 to 95/5, more preferably from 50/50 to 90/10, from the viewpoint of low-temperature fixing ability and high-temperature offset resistance.

The weight ratio of the crystalline polyester to the amorphous polyester (crystalline polyester/amorphous polyester) is preferably from 1/99 to 50/50, more preferably from 5/95 to 40/60, even more preferably from 10/90 to 30/70, from the viewpoint of triboelectric chargeability, storage property, low-temperature fixing ability and durability. Also, a total content of the crystalline polyester and the amorphous polyester is preferably from 50% by weight or more, more preferably from 70 to 100% by weight, even more preferably from 90 to 100% by weight, of the resin binder.

The low-melting point wax contained as a releasing agent in the toner of the present invention is generally referred to as a wax ("Iwanami Rikagaku Jiten (Iwanami Physicochemical Dictionary),"Fourth Edition, p. 1407) has a melting point of from 60° to 85° C., preferably from 60° to 80° C., more preferably from 65° to 80° C., even more preferably from 70° to 80° C. The wax may be dispersed in the resin binder, for example by melt kneading a mixture containing the resin binder and the wax.

The present inventors have further studied the properties of the wax from the viewpoint of the durability of the toner. As a result, the present inventors have fond that a low-melting point wax requires a penetration at 25° C. of 10 or less, preferably 8 or less. As a result of further studies, the present inventors have found that the wax has a penetration at 25° C. of 4 or more, preferably 6 or more, from the viewpoint of low-temperature fixing ability. Therefore, the above-mentioned low-melting point wax in the present invention has a penetration of from 4 to 10, preferably from 6 to 8, from the above viewpoint.

The above-mentioned low-melting point wax having a specified penetration in the present invention is preferably petroleum waxes as prescribed in Japan Industry Standard JIS K2235, specifically at least one member selected from the group consisting of microcrystalline waxes, paraffin waxes and petrolatum, from the viewpoint of satisfying fixing ability and durability. Among them, the microcrystalline waxes and the paraffin waxes are more preferable, and paraffin waxes are even more preferable. Here, the paraffin wax refers to a petroleum wax extracted from petroleum, which is a high-purity purified paraffin wax which is separated and purified from the distillate oil by vacuum distillation to increase the ratio of a linear hydrocarbon.

The content of the releasing agent is preferably from 0.5 to 10 parts by weight, more preferably from 0.5 to 8 parts by weight, even more preferably from 1 to 8 parts by weight, based on 100 parts by weight of the resin binder, from the viewpoint of fixing ability and durability.

The content of the above-mentioned low-melting point wax having a specified penetration is preferably from 0.1 to 10 parts by weight, more preferably from 0.3 to 8 parts by weight, even more preferably from 0.5 to 5 parts by weight, based on 100 parts by weight of the resin binder.

The toner of the present invention may contain other waxes usually used as a releasing agent for a toner within the range so that the effects exhibited by the above-mentioned low-melting point wax having a specified penetration would not be impaired. The content of the above-mentioned low-melting point wax having a specified penetration is preferably 30% by weight or more, more preferably 50% by weight or more, even more preferably 70% by weight or more, even more preferably 100% by weight, of the total amount of the releasing agent.

When the resin binder contains a polyester as a main component, the wax to be used together with the above-mentioned low-melting point wax having a specified penetration is preferably an ester wax, more preferably carnauba wax from the viewpoint of satisfying low-temperature fixing ability and durability.

As the colorant in the present invention, all of the dyes and pigments which are used as colorants for a toner can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner of the present invention can be used as any of black toners, color toners, and full color toners. The amount of the colorant to be added is preferably from 1 to 40 parts by weight, more preferably from 2 to 15 parts by weight, based on 100 parts by weight of the resin binder.

The toner may further contain a charge control agent, and positively chargeable and negatively chargeable charge control agent can be used. The positively chargeable charge control agents are preferably copolymers having a quaternary ammonium salt-containing group, from the viewpoint of image quality (suppression of background fog). Even more preferably, in a positively chargeable toner, the copolymer having quaternary ammonium salt-containing group serving as a charge control resin for giving positive chargeability to the toner can secure an excellent positively chargeability even when the polyester having negative chargeability is contained.

The combination of the resin binder and wax in the present invention accelerates the dispersion of the copolymer having a quaternary ammonium salt-containing group, so that stable chargeability is secured because their compatibility to the copolymer having a quaternary ammonium salt-containing group is very excellent. Therefore, the initial rise of the triboelectric charges is improved, so that necessary triboelectric charges can be obtained with a smaller friction.

Further, the toner of the present invention containing a copolymer having a quaternary ammonium salt-containing group as a charge control agent has a more stable positive chargeability for the positive charging photoconductor, so that background fog can be favorably prevented over a long period of time.

It is preferable that the copolymer having a quaternary ammonium salt-containing group is a compound prepared by the step of polymerizing a monomer mixture containing a monomer represented by the formula (I):

(1)

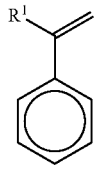

wherein $R^1$ is a hydrogen atom or a methyl group;

a monomer represented by the formula (II):

(II)

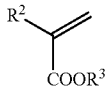

wherein $R^2$ is a hydrogen atom or a methyl group, and $R^3$ is an alkyl group having 1 to 6 carbon atoms; and a monomer represented by the formula (III):

(III)

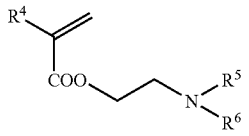

wherein $R^4$ is a hydrogen atom or a methyl group, and each of $R^5$ and $R^6$ is an alkyl group having 1 to 4 carbon atoms, or a quaternalized compound thereof, preferably the monomer represented by the formula (III).

It is desired that the monomer represented by the formula (I) is a styrene in which $R^1$ is a hydrogen atom, that the monomer represented by the formula (II) is a monomer in which $R^2$ is a hydrogen atom and $R^3$ is an alkyl group having 1 to 4 carbon atoms, preferably butyl acrylate in which $R^2$ is a hydrogen atom and $R^3$ is a butyl group, and that the monomer represented by the formula (III) is a monomer in which $R^4$ is a methyl group, and each of $R^5$ and $R^6$ is a methyl group or an ethyl group, preferably dimethylaminoethyl methacrylate in which each of $R^4$, $R^5$ and $R^6$ is a methyl group.

It is desired that the content of the monomer represented by the formula (I) of the monomer mixture is from 60 to 97% by weight, preferably from 70 to 90% by weight, that the content of the monomer represented by the formula (II) is from 1 to 33% by weight, preferably from 5 to 20% by weight, and that the content of the monomer represented by the formula (III) or a quaternalized compound thereof is from 2 to 35% by weight, preferably from 5 to 20% by weight.

The polymerization of the monomer mixture can be carried out, for instance, by heating a monomer mixture to a temperature of from 50° to 100° C. in the presence of a polymerization initiator such as azobisdimethylvaleronitrile under an inert gas atmosphere. The polymerization method may be any of solution polymerization, suspension polymerization, and bulk polymerization, and preferably solution polymerization.

The solvent includes organic solvents such as toluene, xylene, dioxane, ethylene glycol monomethyl ether, ethyl acetate and methyl ethyl ketone; and mixed solvents of these organic solvents with a lower alcohol such as methanol, ethanol, propanol or isopropanol.

Incidentally, in the present invention, when the monomer represented by the formula (III) is used, the copolymer obtained as described above can be further quaternarized with a quaternarization agent, to give the above-described copolymer having a quaternary ammonium salt-containing group. The quaternarization agent includes methyl p-toluenesulfonate, dimethyl sulfate, methyl hydroxynaphthalenesulfonate, methyl chloride, methyl iodide, benzyl chloride and the like. Among them, methyl p-toluenesulfonate is preferable because stable and high triboelectric chargeability is obtained. The amount of the quaternarization agent used is preferably from 0.8 to 1.0 mol per 1 mol of the monomer represented by the formula (III). The quaternarization of the copolymer described above can be carried out, for instance, by heating the copolymer and the quaternarization agent to a temperature of from 60° to 90° C. in the solvent.

Also, when the quaternarized compound of the monomer represented by the formula (III) is used, those obtained by quaternarization of the monomer represented by the formula (III) using the same quaternarization agent as above can be used. Alternatively, a quaternary ammonium halide obtained by treatment with an alkyl halide such as methyl chloride can be used as the quaternarized compound of the monomer represented by the formula (III), and the copolymer obtained using the quaternary ammonium halide is treated with an acid such as p-toluenesulfonic acid or hydroxynaphthalenesulfonic acid to perform counter ion exchange, to give the desired copolymer having a quaternary ammonium salt-containing group.

The weight-average molecular weight of the thus obtained copolymer having a quaternary ammonium salt-containing group is 5,000 or more from the viewpoint of storage stability, and the weight-average molecular weight is preferably 100,000 or less, from the viewpoint of compatibility with the resin, more preferably from 10,000 to 50,000.

The content of the copolymer having a quaternary ammonium salt-containing group is preferably from 0.5 to 40 parts by weight, more preferably from 1 to 30 parts by weight, even more preferably from 5 to 25 parts by weight, based on 100 parts by weight of the resin binder, in order to obtain an appropriate level of triboelectric charges.

The negatively chargeable charge control agent includes metal compounds of salicylic acid derivatives, metal compounds of benzilic acid derivatives and the like.

The metal compound of salicylic acid derivatives are preferably metal compounds of a salicylic acid derivative represented by the formula (IV):

(IV)

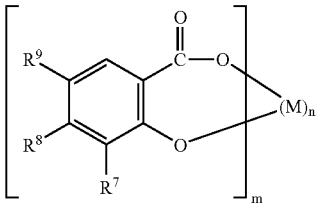

wherein each of $R^7$, $R^8$, and $R^9$ is independently a hydrogen atom, a linear or branched, alkyl group having 1 to 10 carbon atoms or alkenyl group having 2 to 10 carbon atoms; M is zinc, zirconium, chromium, aluminum, copper, nickel, or cobalt; m is an integer of 2 or more; and n is an integer of 1 or more. Here, the metal compound of a salicylic acid derivative may be either a metal salt or a metal complex. These compounds can be used alone or in admixture of two or more kinds. Since the metal compound of a salicylic acid derivative is colorless, the metal compound can be suitably used in a color toner.

In the formula (IV), $R^8$ is preferably a hydrogen atom, and each of $R^7$ and $R^9$ is preferably a branched alkyl group, more preferably a tert-butyl group.

M is even more preferably zinc which has a high electronegativity and excellent effect of giving chargeability.

Commercially available products which are suitably used in the present invention where $R^8$ is a hydrogen atom, each of $R^7$ and $R^9$ is a tert-butyl group include "BONTRON E-84" (M: zinc; commercially available from Orient Chemical Co., Ltd.); "TN-105" (M: zirconium; commercially available from Hodogaya Chemical Industries); "BONTRON E-81" (M: chromium; commercially available from Orient Chemical Co., Ltd.); "BONTRON E-88" (M: aluminum; commercially available from Orient Chemical Co., Ltd.), and the like.

In addition, the metal compounds of a salicylic acid derivative can be readily prepared in accordance with the method described in CLARK, J. L. and KAO, H. (1948), *J. Amer. Chem. Soc.* 70, 2151. For instance, the metal compound can be obtained as a zinc compound by combining and mixing 2 moles of sodium salt of salicylic acid (containing sodium salt of salicylic acid derivatives) with 1 mole of zinc chloride in a solvent, and stirring the mixture with heating. This metal compound is a crystal showing a white color, so that it does not cause coloration when dispersed in the resin binder. Metal compounds other than the zinc compound can be prepared by a method similar to that described above.

The content of the metal compound of a salicylic acid derivative, based on 100 parts by weight of the resin binder, is preferably 0.5 parts by weight or more, from the viewpoint of improving the triboelectric chargeability, and the content is preferably 10 parts by weight or less, from the viewpoint of preventing detachment of the charge control agent, more preferably from 1 to 5 parts by weight.

The metal compounds of benzilic acid derivatives are preferably metal compounds of a benzilic acid derivative represented by the formula (V):

(V)

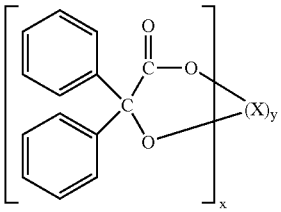

wherein X is boron or aluminum; x is an integer of 2 or more; and y is an integer of 1 or more.

Here, the metal compound may be either a metal salt or a metal complex.

Commercially available products of the metal salt compound of a benzilic acid derivative include "LR147" (X: boron; commercially available from Japan Carlit), "LR-297" (X: aluminum; commercially available from Japan Carlit); and the like.

The content of the metal salt compound of a benzilic acid derivative, based on 100 parts by weight of the resin binder, is preferably 0.3 parts by weight or more, from the viewpoint of improving the initial rise of triboelectric charging, and the content is preferably 3 parts by weight or less, from the viewpoint of preventing lowering of the level of triboelectric charges by electroconductivity of the charge control agent, more preferably from 0.5 to 2 parts by weight.

In the present invention, as a charge control agent, besides the copolymer having a quaternary ammonium salt-containing group, the metal compound of a salicylic acid derivative and the metal salt compound of a benzilic acid derivative, a usually employed charge control agent can be also used together therewith.

In the toner of the present invention, additives such as fluidity improvers, electric conductivity modifiers, extenders, reinforcing fillers such as fibrous substances, antioxidants, anti-aging agents, and cleanability improvers may be appropriately added internally or externally.

The toner of the present invention may be prepared by any of conventionally known methods such as a kneading and pulverization method, an emulsion phase-inversion method and a polymerization method, and the kneading and pulverization method including the step of melt-kneading raw materials is preferable since the preparation of the toner is facilitated.

The kneader usable in the melt-kneading of raw materials includes a closed type kneader, a closed type single-screw or twin-screw extruder, an open-roller type kneader and the like. In the present invention, it is preferable that the toner of the present invention is prepared through a melt-kneading step using an open-roller type kneader, from the viewpoint of satisfying both of fixing ability and durability, which have been a problem to be solved, in an even higher level of accomplishment. Therefore, the crystalline polyester and the above-mentioned low-melting point wax that are less likely to be dispersed in other melt and kneading process can be excellently dispersed, so that the durability of the toner can be even further improved.

The raw material to be fed to the open-roller type kneader is preferably a pre-mixture of the resin binder, the wax and the colorant, and further an additive such as a charge control agent to be added as occasion demands with a Henschel mixer or the like.

The open-roller type kneader used in the present invention is preferably a continuous type kneader, and that the kneader has two rollers, one of which is a heat roller and the other is a cooling roller.

The heat roller has a rotational speed of preferably from 2 to 100 m/min. The cooling roller has a rotational speed of preferably from 2 to 100 m/min, more preferably from 10 to 60 m/min, even more preferably from 15 to 50 m/min. In addition, it is preferable that the two rollers have rotational speeds different from each other, and the ratio of the rotational speeds of the two rollers (cooling roller/heat roller) is preferably from 1/10 to 9/10, more preferably from 3/10 to 8/10.

The difference in temperature between the heat roller and the cooling roller is preferably from 60° to 150° C., more preferably from 80° to 120° C. Here, the temperature of the roller can be adjusted by a heating medium passing through the inner portion of the roller, and each roller may be divided in two or more portions in the inner portion of the roller, each being connected to heating media of different temperatures.

In order to make the kneaded mixture more easily attached to the heat roller, it is preferable that the temperature of the raw material feeding side of the heat roller is adjusted to be higher than both the softening point of the resin binder and the melting point of the wax, and that the temperature of the cooling roller is adjusted to be lower than both the softening point of the resin binder and the melting point of the wax.

It is preferable that the temperature of the raw material feeding side of the heat roller is adjusted to be higher than both the softening point of the resin binder and the melting point of the wax, more preferably higher than the higher of the softening point of the resin binder and the melting point of the wax by 0° to 80° C., even more preferably by 5° to 50° C. It is preferable that the temperature of the cooling roller is adjusted to be lower than both of the softening point of the resin binder and the melting point of the wax, more preferably lower than the lower of the softening point of the resin binder and the melting point of the wax by 0° to 50° C., even more preferably by 10° to 50° C.

The two rollers are preferably arranged closely to each other, and the gap between the rollers is preferably from 0.01 to 5 mm, more preferably from 0.05 to 2 mm.

The structure, size, material and the like of the roller are not particularly limited, and the roller surface may have any of smooth, wavy or rugged surfaces.

Next, the resulting kneaded mixture is cooled to a pulverizable hardness, pulverized, and classified as occasion demands, to give a toner. The volume-median particle size ($D_{50}$) of the toner obtained in the present invention is preferably from 3 to 15 μm. Further, a fluidity improver such as hydrophobic silica or fine resin particles made of polytetrafluoroethylene or the like may be externally added to roughly pulverized products obtained in the preparation stage of the toner or the toner.

Since the toner of the present invention has excellent low-temperature and durability, the effects of the toner are more remarkably exhibited when used in an oil-less fusing apparatus.

The toner of the present invention can be used in any of the development method alone as a developer in the case where fine magnetic material powder is contained, or as a nonmagnetic monocomponent developer in the case where fine magnetic material powder is not contained, or as a two-component developer by mixing the toner with a carrier without particular limitation. By the combination of the crystalline polyester and the wax having a specified property, the friction resistance during the toner development becomes excellent, so that the toner of the present invention can be even more suitably used as a toner for nonmagnetic monocomponent development.

EXAMPLES

The following examples further describe and demonstrate embodiments of the present invention. The examples are given solely for the purposes of illustration and are not to be construed as limitations of the present invention.

[Softening Point of the Resin]

Softening point refers to a temperature corresponding to ½ of the height of the S-shaped curve showing the relationship between the downward movement of a plunger (flow length) and temperature, namely, a temperature at which half of the resin flows out, when measured by using a flow tester of the "koka" type ("CFT-500," manufactured by Shimadzu Corporation) in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

[Number-Average Molecular Weight and Weight-Average Molecular Weight of the Resin]

The molecular weight distribution is determined by gel permeation chromatography in accordance with the following methods. The number-average molecular weight and the weight-average molecular weight are calculated from the molecular weight distribution obtained.

(1) Preparation of Sample Solution

A crystalline polyester is dissolved in chloroform, and an amorphous polyester is dissolved in tetrahydrofuran, each so as to have a concentration of 0.5 g/100 ml. Next, this solution is filtered with a fluororesin filter having a pore size of 2 μm (FP-200, manufactured by Sumitomo Electric Industries, Ltd.) to exclude an insoluble component, to give a sample solution.

(2) Determination of Molecular Weight Distribution

As an eluant, chloroform is allowed to flow when the crystalline polyester is determined, or tetrahydrofuran is allowed to flow when the amorphous polyester is determined at a flow rate of 1 ml per minute, and the column is stabilized in a thermostat at 40° C. One-hundred microliters of the sample solution is injected to the column to determine the molecular weight distribution. The molecular weight of the sample is calculated on the basis of a calibration curve previously prepared. The calibration curve of the molecular weight is one prepared by using several kinds of monodisperse polystyrenes as standard samples.

Analyzer: CO-8010 (manufactured by Tosoh Corporation)

Analyzing Column: GMHLX+G3000HXL (manufactured by Tosoh Corporation)

[Maximum Peak Temperature for Heat of Fusion and Glass Transition Temperature of the Resin and Melting Point of Wax]

A maximum peak temperature for heat of fusion is determined with a sample using a differential scanning calorimeter (DSC 210, manufactured by Seiko Instruments, Inc.), when the sample is treated by raising its temperature to 200° C., cooling the sample at a cooling rate of 10° C./min. to 0° C., and thereafter heating the sample at a heating rate of 10° C./min. Here, the maximum peak temperature in a case of a wax is referred to as a melting point. In addition, the temperature of an intersection of the extension of the baseline in a temperature range equal to or lower than the maximum peak temperature and the tangential line showing the maximum slope between the kickoff of the peak and the top of the peak in the above-mentioned determination in the amorphous resin is referred to as a glass transition point.

[Penetration of Wax]

Under thermostatic conditions (25° C.), a needle prescribed to have a total mass of 100 g in accordance with 5.4 of JIS K2235 is penetrated vertically into the sample for 5 seconds. The depth of the penetrated needle is determined to the order of 0.1 mm, and a value obtained by multiplying a found value by a factor of 10 is referred to as penetration.

Preparation Example 1 for Crystalline Polyester

The amount 1620 g of 1,4-butanediol, 236 g of 1,6-hexanediol, 2320 g of fumaric acid and 1.5 g of dibutyltin oxide are reacted under a nitrogen atmosphere at 140° C. for 4 hours. Thereafter, the temperature is raised to 200° C. at a rate of 10° C./hour, and the components are further reacted at 200° C. for 1 hour, and then under reduced pressure of 8.3 kPa for 1 hour. The reaction ratio is 98%. Thereafter, 350 g of a propylene oxide (average number of moles: 2.2 moles) adduct of bisphenol A is added thereto, and the components are reacted under normal pressure for 1 hour, and then under reduced pressure of 8.3 kPa for 1 hour. The resulting resin has a softening point of 101° C., a maximum peak temperature of heat of fusion of 98° C., a number-average molecular weight of 4,800, and a weight-average molecular weight of 120,000. The resulting resin is referred to as Resin A.

Preparation Example 1 for Amorphous Polyester

The amount 2979 g of a propylene oxide (average number of moles: 2.2 moles) adduct of bisphenol A, 1169 g of an ethylene oxide (average number of moles: 2.0 moles) adduct of bisphenol A, 1077 g of terephthalic acid, 373 g of dodecenylsuccinic acid, 344 g of trimellitic anhydride and 15 g of dibutyltin oxide are reacted under a nitrogen atmosphere at 230° C. while stirring, until its softening point reaches 145° C. The resulting resin has a glass transition temperature of 63° C., a maximum peak temperature of heat of fusion of 72° C., a number-average molecular weight of 2,200, and a weight-average molecular weight of 50,000. The resulting resin is referred to as Resin B.

Preparation Example 2 for Crystalline Polyester

The amount 1575 g of 1,4-butanediol, 870 g of 1,6-hexanediol, 2950 g of fumaric acid, 2 g of hydroquinone and 4 g of dibutyltin oxide are reacted under a nitrogen atmosphere at 160° C. for 5 hours. Thereafter, the temperature is raised to 200° C. at a rate of 10° C./hour, and the components are further reacted at 200° C. for 1 hour, and then under reduced pressure of 8.3 kPa for 1 hour until its softening point reaches 110° C. The resulting resin has a maximum peak temperature of heat of fusion of 107° C., a number-average molecular weight of 4,200, and a weight-average molecular weight of 72,000. The resulting resin is referred to as Resin C.

Preparation Example 2 for Amorphous Polyester

The amount 568 g of a propylene oxide (average number of moles: 2.2 moles) adduct of bisphenol A, 792 g of an ethylene oxide (average number of moles: 2.2 moles) adduct of bisphenol A, 640 g of terephthalic acid and 10 g of tin octylate are reacted under a nitrogen atmosphere at 210° C. while stirring, until its softening point reaches 110° C. The resulting resin has a glass transition temperature of 67° C., a maximum peak temperature of heat of fusion of 70° C., a number-average molecular weight of 4,000, and a weight-average molecular weight of 15,000. The resulting resin is referred to as Resin D.

Preparation Example for Charge Control Resin

Two-hundred and fifty grams of methanol, 200 g of toluene, 500 g of styrene, 40 g of butyl acrylate, 60 g of dimethylaminoethyl methacrylate and 12 g of azobisdimethylvaleronitrile are polymerized under a nitrogen atmosphere at 70° C. for 10 hours. The resulting reaction solution is cooled, and 150 g of toluene, 100 g of ethanol and 71 g of methyl p-toluenesulfonate are added thereto. The resulting mixture is agitated at 70° C. for 5 hours, to carry out quaternalization. The reaction solution is heated to 100° C., and the solvent is distilled off under reduced pressure. Thereafter, the resulting product is pulverized with a jet mill, to give a charge control resin (quaternary ammonium base-containing copolymer, weight-average molecular weight: 14,000). The resulting charge control resin is referred to as Resin E.

Example A1

Twenty parts by weight of Resin A, 80 parts by weight of Resin B, 4 parts by weight of a carbon black "REGAL-330R" (manufactured by Cabot Corporation), 4 parts by weight of a positively chargeable charge control agent "BONTRON N-04" (manufactured by Orient Chemical Co., Ltd.), and 2 parts by weight of a paraffin wax "HNP-9" (manufactured by NIPPON SEIRO CO., LTD., melting point: 79° C., penetration: 7) are mixed with a Henschel mixer. Thereafter, the mixture is melt-kneaded with a twin-screw extruder, and pulverized and classified using a jet mill and a dispersion separator, to give a powder having a volume-median particle size ($D_{50}$) of 9.5 μm.

To 100 parts by weight of the resulting powder are added 0.3 parts by weight of fine polytetrafluoroethylene particles "KTL-500F" (manufactured by KITAMURA LIMITED) and 0.5 parts by weight of a hydrophobic silica "TS-720" (manufactured by Wacker Chemical, average particle size: 12 nm), and the mixture is mixed with a Henschel mixer, to give a toner.

Example A2

The same procedures as in Example A1 are carried out except that 2 parts by weight of "HNP-5" (manufactured by NIPPON SEIRO CO., LTD., melting point: 66° C., penetration: 4) is used in place of "HNP-9" as a paraffin wax, to give a toner.

Example A3

The same procedures as in Example A1 are carried out except that 5 parts by weight of Resin E is further used, to give a toner.

Example A4

The same procedures as in Example A1 are carried out except that the mixture is melt-kneaded with an open roll-type continuous kneader "Kneadex" (manufactured by MITSUI MINING COMPANY, LIMITED) in place of the twin-screw extruder, to give a toner.

The open-roller type continuous kneader used had an outer roller diameter of 0.14 m and an effective roller length of 0.8 m, and operated under the conditions that a rotational speed of a heat roller (front roller) is 33 m/min, a rotational speed of a cooling roller (rear roller) is 22 m/min, and a gap between the rollers is 0.1 mm. In addition, the temperature of the heating medium and the cooling medium in the respective rollers are set, so that the temperature at the raw material feeding side of the heat roller is 150° C., that the temperature at the kneaded mixture discharging side of the heat roller is 130° C., that the temperature at the raw material feeding side of the cooling roller is 35° C., and that the temperature at the kneaded mixture discharging side of the cooling roller is 30° C. The feeding rate for the raw material mixture is 5 kg/hr, and the average residence time is about 5 minutes.

Example A5

The same procedures as in Example A4 are carried out except that 5 parts by weight of Resin E is further used, to give a toner.

Comparative Example A1

The same procedures as in Example A1 are carried out except that 2 parts by weight of Fischer-Tropsch wax "FT100" (manufactured by NIPPON SEIRO CO., LTD., melting point (congealing point): 95° C., penetration: 1) is used in place of the paraffin wax, to give a toner.

Comparative Example A2

The same procedures as in Example A1 are carried out except that 2 parts by weight of "Carnauba Wax C1" (manufactured by K. K. Kato Yoko, melting point: 88° C., penetration: 1) is used in place of the paraffin wax, to give a toner.

Comparative Example A3

The same procedures as in Example A1 are carried out except that Resin A is not used, and that the amount of Resin B used is changed to 100 parts by weight.

Comparative Example A4

The same procedures as in Example A1 are carried out except that 2 parts by weight of "SP-3040" (manufactured by NIPPON SEIRO CO., LTD., melting point: 65° C., penetration: 12) is used in place of "HNP-9" as a paraffin wax, to give a toner.

Test Example A1 [Low-Temperature Fixing Ability]

A toner is loaded on a modified apparatus of a nonmagnetic monocomponent development, oil-less fusing type printer "HL-1060" (manufactured by BROTHER INDUSTRIES, LTD.), and image-printing is carried out while varying the fixing temperatures from 100° to 200° C. A sand-rubber eraser to which a load of 500 g is applied is moved backward and forward five times over a fixed image obtained at each fixing temperature. The temperature at which the ratio of image densities before and after rubbing (after rubbing/before rubbing) initially exceeds 90% is referred to as a lowest fixing temperature. The low-temperature fixing ability is evaluated in accordance with the following evaluation criteria. The results are shown in Table 1.

[Evaluation Criteria]

◎: The lowest fixing temperature is less than 110° C.

○: The lowest fixing temperature is 110° C. or more and less than 120° C.

Δ: The lowest fixing temperature is 120° C. or more and less than 140° C.

x: The lowest fixing temperature is 140° C. or more.

Test Example A2 [Durability]

A toner is loaded on a nonmagnetic monocomponent development, oil-less fusing type printer "HL-1060" (manufactured by BROTHER INDUSTRIES, LTD.), and a fixed image having a blackened ratio of 5% is printed for 10,000 sheets. After printing, the deposition on the developer blade and the image quality of the 10,000th sheet are visually observed, and the durability is evaluated in accordance with the following evaluation criteria. The results are shown in Table 1.

[Evaluation Criteria]

◎: The deposition on the developer blade is not found, and the image quality is excellent, thereby being further favorable in actual use.

○: The deposition on the developer blade is slightly found, but there is no generation of any lines on the fixed image, thereby causing no problem in actual use.

x: Lines are generated on the fixed image due to the deposition on the developer blade, thereby making it impossible for actual use.

Test Example A3 [Background Fogging]

The background fogging generated on a 10,000th printed sheet in Test Example A2 is determined using a color-difference meter "CR-321" (manufactured by MINOLTA CO., LTD.), and the background fogging is evaluated in accordance with the following evaluation criteria. The results are shown in Table 1.

[Evaluation Criteria]

TABLE 1

| | Resin Binder | Parts by Weight | Wax Kind | Wax Melting Point (° C.) | Wax Penetration | Parts by Weight | Charge Control Agent | Parts by Weight | Kneader | Low-Temp. Fixing Ability | Dura-bility | Back-ground Fogging |
|---|---|---|---|---|---|---|---|---|---|---|---|---|
| Ex. A1 | Resin A<br>Resin B | 20<br>80 | Paraffin Wax | 79 | 7 | 2 | BONTRON N-04 | 4 | Twin-Screw Extruder | ○ | ◎ | ○ |
| Ex. A2 | Resin A<br>Resin B | 20<br>80 | Paraffin Wax | 66 | 4 | 2 | BONTRON N-04 | 4 | Twin-Screw Extruder | ○ | ○ | ○ |
| Ex. A3 | Resin A<br>Resin B | 20<br>80 | Paraffin Wax | 79 | 7 | 2 | BONTRON N-04<br>Resin E | 4<br>5 | Twin-Screw Extruder | ○ | ◎ | ◎ |
| Ex. A4 | Resin A<br>Resin B | 20<br>80 | Paraffin Wax | 79 | 7 | 2 | BONTRON N-04 | 4 | Open Roll-type Kneader | ◎ | ◎ | ○ |
| Ex. A5 | Resin A<br>Resin B | 20<br>80 | Paraffin Wax | 79 | 7 | 2 | BONTRON N-04<br>Resin E | 4<br>5 | Open Roll-type Kneader | ◎ | ◎ | ◎ |
| Comp. Ex. A1 | Resin A<br>Resin B | 20<br>80 | Fischer-Tropsch Wax | 95 | 1 | 2 | BONTRON N-04 | 4 | Twin-Screw Extruder | X | ◎ | ○ |
| Comp. Ex. A2 | Resin A<br>Resin B | 20<br>80 | Carnauba Wax | 88 | 1 | 2 | BONTRON N-04 | 4 | Twin-Screw Extruder | X | ○ | ○ |
| Comp. Ex. A3 | Resin B | 100 | Paraffin Wax | 79 | 7 | 2 | BONTRON N-04 | 4 | Twin-Screw Extruder | Δ | X | X |
| Comp. Ex. A4 | Resin A<br>Resin B | 20<br>80 | Paraffin Wax | 65 | 12 | 2 | BONTRON N-04 | 4 | Twin-Screw Extruder | ○ | X | X |

Note)
Resin A: Crystalline Polyester,
Resin B: Amorphous Polyester
Resin E: Charge Control Resin
◎: The background fogging is less than 0.5.
○: The background fogging is 0.5 or more and less than 1.0.
X: The background fogging is 1.0 or more.

From the results of Table 1, as compared to Comparative Examples A1 to A4, the toners of Examples A1 to A5 containing a crystalline polyester as a resin binder and a wax having a desired melting point and penetration have favorable results in both of low-temperature fixing ability and durability, so that a significant effect in energy conservation is expected. Further, it can be seen that the toners of Examples A3 and A5 using a charge control resin as a charge controlling agent hardly causes the generation of background fogging even after durability printing, so that the toners are also excellent in chargeabilty.

In addition, all of the toners of Examples A1 to A5 are black toners, and similar excellent effects can be obtained in color toners as in the black toners.

Example B1

Ten parts by weight of Resin C, 90 parts by weight of Resin D, 3.5 parts by weight of a colorant "ECB-301" (manufactured by DAINICHISEIKA COLOR & CHEMICALS MFG. CO., LTD.), 1 part by weight of a negatively chargeable charge control agent "BONTRON E-84" (manufactured by Orient Chemical Co., Ltd.), and 3 parts by weight of a paraffin wax "HNP-9" (manufactured by NIPPON SEIRO CO., LTD., melting point: 79° C., penetration: 7) are mixed with a Henschel mixer. Thereafter, the mixture is melt-kneaded with an open-roller type continuous kneader "Kneadex" (manufactured by MITSUI MINING COMPANY, LIMITED) in the same manner as in Example A4, to give a kneaded mixture. The resulting kneaded mixture is cooled in the air, and roughly pulverized with Rotoplex (manufactured by HOSOKAWA ALPINE Aktiengesellschaft & Co. OHG), to give a roughly pulverized product of which largest particle-size is 2 mm. One-hundred parts by weight of the resulting roughly pulverized product and 1.0 parts by weight of a hydrophobic silica "R972" are mixed with a Henschel mixer, and the resulting mixture is finely pulverized and classified to cut off its upper limit with a counter jet mill "400AFG" (manufactured by Hosokawa Micron Corporation), and further classified to cut off its lower limit with a classifier "TTSP" (manufactured by Hosokawa Micron Corporation), to give a toner. The resulting toner has a volume-median particle size ($D_{50}$) of 5.8 μm.

Example B2

The same procedures as in Example B1 are carried out except that 1 part by weight of "LR-147" (manufactured by Japan Carlit) is used in place of "BONTRON E-84" as a negatively chargeable charge control agent, to give a toner.

Comparative Example B1

The same procedures as in Example B1 are carried out except that 3 parts by weight of a polypropylene wax "NP-105" (manufactured by MITSUI CHEMICALS, INC., melting point: 145° C., penetration: 1) is used in place of the paraffin wax, to give a toner.

Comparative Example B2

The same procedures as in Example B1 are carried out except that Resin C is not used and the amount of Resin D used is changed to 100 parts by weight, to give a toner.

Test Example B1 [Low-Temperature Fixing Ability]

A toner is loaded to a nonmagnetic monocomponent development, oil-less fusing type printer "MicroLine5100" (manufactured by Oki Data Corporation, equipped with negatively charged organic photoconductor), and a solid image (amount of toner adhesion: 0.60 mg/cm$^2$), a square of 5 cm per side, is obtained while varying the fixing temperatures from 100° to 200° C. A sand-rubber eraser to which a load of 500 g is applied is moved backward and forward five times over a fixed image obtained at each fixing temperature. The temperature at which the ratio of image densities before and after rubbing (after rubbing/before rubbing) initially exceeds 90% is referred to as a lowest fixing temperature. The low-temperature fixing ability is evaluated in accordance with the following evaluation criteria. The results are shown in Table 2.

[Evaluation Criteria]

TABLE 2

| | Resin Binder | Parts by Weight | Wax Kind | Wax Melting Point (° C.) | Wax Penetration | Parts by Weight | Charge Control Agent | Parts by Weight | Kneader | Low-Temp. Fixing Ability |
|---|---|---|---|---|---|---|---|---|---|---|
| Ex. B1 | Resin C<br>Resin D | 10<br>90 | Paraffin Wax | 79 | 7 | 3 | BONTRON E-84 | 1 | Open Roll-type Kneader | ◎ |
| Ex. B2 | Resin C<br>Resin D | 10<br>90 | Paraffin Wax | 79 | 7 | 3 | LR-147 | 1 | Open Roll-type Kneader | ◎ |
| Comp. Ex. B1 | Resin C<br>Resin D | 10<br>90 | Polypropylene Wax | 145 | 1 | 3 | BONTRON E-84 | 1 | Open Roll-type Kneader | Δ |
| Comp. Ex. B2 | Resin D | 100 | Paraffin Wax | 79 | 7 | 3 | BONTRON E-84 | 1 | Open Roll-type Kneader | X |

Note)
Resin C: Crystalline Polyester
Resin D: Amorphous Polyester
◎: The lowest fixing temperature is less than 110° C.
○: The lowest fixing temperature is 110° C. or more and less than 120° C.
Δ: The lowest fixing temperature is 120° C. or more and less than 140° C.
X: The lowest fixing temperature is less than 140° C. or more.

It can be seen from the results of Table 2 that as compared to Comparative Examples B1 and B2, the toners of Examples B1 and B2 containing a crystalline polyester as a resin binder and a wax having a desired melting point and penetration have favorable results also in low-temperature fixing ability.

The toner for electrostatic image development of the present invention can be used, for instance, for the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development, comprising:

a resin binder comprising a crystalline polyester and an amorphous polyester resin, wherein the crystalline/amorphous resin weight ratio is from 5/95 to 40/60;

a releasing agent comprising a wax having a melting point of from 60 to 80° C. and a penetration at 25° C. of from 4 to 10; and a colorant;

wherein the crystalline polyester is prepared by polycondensing an alcohol component containing 80% by mol or more of an aliphatic diol having 2 to 6 carbon atoms and a carboxylic acid component containing 80% by mol or more of an aliphatic dicarboxylic compound having 2 to 8 carbon atoms, wherein all of the wax present in the toner has a melting point of 60-80° C. and a penetration at 25° C. of from 4 to 10.

2. The toner according to claim 1, wherein the wax is a paraffin wax.

3. The toner according to claim 1, comprising from 0.5 to 10 parts by weight of the releasing agent, based on 100 parts by weight of the resin binder, and wherein the releasing agent comprises 30% or more by weight of the wax.

4. The toner according to claim 1, comprising from 1 to 50% of the crystalline polyester, by weight of the resin binder.

5. The toner according to claim 1, further comprising a charge control agent comprising a quaternary ammonium salt group-containing copolymer.

6. The toner according to claim 1, wherein the toner is a toner for nonmagnetic monocomponent development.

7. The toner according to claim 1, comprising from 0.5 to 10 parts by weight of the wax, based on 100 parts by weight of the resin binder.

8. The toner according to claim 1, wherein the wax has a melting point of 60-70° C.

9. The toner of claim 1, wherein the alcohol component of the crystalline polyester comprises 1,4-butanediol and 1,6-hexanediol, and the carboxylic acid component comprises fumaric acid.

10. The toner according to claim 1, wherein the alcohol component comprises 1,6-hexanediol and 1,4-butanediol.

11. The toner of claim 1, wherein the amorphous polyester comprises polymerized units of terephthalic acid, dodecenylsuccinic acid, trimellitic anhydride, a bisphenol A adduct of propylene oxide and a bisphenol A adduct of ethylene oxide.

12. The toner of claim 1, wherein the amorphous resin comprises polymerized units of terephthalic acid, a bisphenol A adduct of propylene oxide and a bisphenol A adduct of ethylene oxide.

13. The toner of claim 1, wherein the wax is dispersed in the resin binder.

14. The toner according to claim 1, wherein the crystalline polyester is prepared by polycondensing an alcohol component having 4 to 6 carbon atoms and a carboxylic acid component having from 6 to 8 carbon atoms.

15. The toner according to claim 14, wherein the wax is a paraffin wax having a melting point of 66-79° C., and a penetration of 4-7.

* * * * *